United States Patent [19]

Rearick

[11] 4,076,500

[45] Feb. 28, 1978

[54] TREATMENT OF TEXTILE MATERIALS

[75] Inventor: William A. Rearick, Charlotte, N.C.

[73] Assignee: ICI Americas Inc., Wilmington, Del.

[21] Appl. No.: 697,590

[22] Filed: Jun. 18, 1976

[51] Int. Cl.[2] ..... D06L 1/02

[52] U.S. Cl. ..... 8/139.1; 8/125; 8/142

[58] Field of Search ..... 8/139.1, 125, 137, 142; 252/172, 103, 104

[56] References Cited

U.S. PATENT DOCUMENTS

| | | | |
|---|---|---|---|
| 2,790,699 | 4/1957 | White | 8/139.1 |
| 2,803,517 | 8/1957 | White | 8/139.1 |
| 3,507,609 | 4/1970 | Gorrafa | 8/125 |
| 3,630,661 | 12/1971 | Ramie et al. | 8/139.1 |
| 3,701,627 | 10/1972 | Grunewalder | 8/139.1 |
| 3,859,223 | 1/1975 | Castantas et al. | 8/139.1 |

*Primary Examiner*—William E. Schulz

[57] ABSTRACT

A process for the scouring and bleaching of textile materials containing cotton which comprises degreasing and dewaxing the materials by contacting them with an emulsion of an aqueous solution of an alkaline compound emulsified in a chlorinated solvent, removing the chlorinated solvent from the materials with steam, padding the materials with an aqueous solution of a peroxygen compound, and then subjecting the materials to the action of steam.

10 Claims, No Drawings

TREATMENT OF TEXTILE MATERIALS

This invention relates to the treatment of textile materials and more particularly to the scouring and bleaching of textile materials containing cotton.

It is known that prior to dyeing textile materials containing cotton, the materials must be prepared so that they do not contain sufficient color to interfere with the shade or brightness of the dye and also so that the dye can be readily and evenly absorbed by the material. In order that the textile material may be adequately absorbent, it is essential to remove the greater part of the natural wax present in the cotton as well as the starch which in the case of woven goods has been previously introduced during the warp sizing process. Furthermore, the continuous dyeing process which are now used allow only a short time of contact of the cloth with the dye liquid, and hence the cloth must be prepared so as to absorb not only adequately but also rapidly. In addition, a treatment designed to lighten the color and to remove motes and any non-cellulosic impurities which may spoil the appearance of the finished cloth is desirable.

It is known that cotton goods may be prepared for dyeing, printing or other finishing treatment by means of a severe scouring treatment with alkali, for example, woven piece goods often receive an alkaline kier boil and even in many cases a kier boil with alkali followed by treatment with hypochlorite. It is also known that textile materials containing cotton may be prepared for dyeing, printing and other finishing, by a scouring and bleaching process which comprises applying to the textile materials a chlorinated solvent, removing the solvent from the textile materials, preferably by means of steam, padding the goods with an aqueous solution of a peroxygen compound, and then subjecting the textile materials to the action of steam whereby the materials are scoured and bleached.

It has now been discovered, quite unexpectedly, that the scouring and bleaching of textile goods containing cotton can be improved by a process which comprises contacting the goods prior to bleaching with an emulsion of an aqueous solution of an alkaline compound in a chlorinated solvent. It is believed that the emulsified alkaline compound in the chlorinated solvent facilitates the softening of the motes during steaming. After the motes are sufficiently softened, they are readily bleached by the bleaching agent in a subsequent stage of the process. The process is easy to carry out and provides a high degree of bleaching of the textile fibers, and a full-white bleach can be achieved in the majority of cases. Without further treatment, the fibers are suitable for use in subsequent dyeing and other finishing operations. The exceptional absorbency of the treated materials enables extremely good penetration of dyestuff into the fibers, thereby insuring dyeing to solid shades which are resistant to shade differences.

Accordingly, the present invention provides a multistaged process for the scouring and bleaching of textile materials containing cotton which comprises degreasing and dewaxing said materials by passing the materials through an emulsion of an aqueous solution of an alkaline compound in a chlorinated solvent, treating the materials with steam, padding the material in an aqueous solution of a peroxygen compound, and then subjecting the goods to the action of steam.

The process of the present invention may be modified in ways which will be readily apparent to those skilled in the art without departing from the scope of the present invention. For example, the emulsion of an aqueous solution of an alkaline compound in the chlorinated solvent may also contain minor amounts of treating agents well known in the prior art, such as an enzyme desizing agent. Additional process steps may be added by treatment of the textile materials prior to treatment with the emulsion or by the addition of various processing steps subsequent to bleaching and steaming. For example, textile materials containing cotton which had been treated with the emulsion and bleaching solution and steamed in accordance with the present invention may be treated with a second peroxide solution and steamed a second time as provided in U.S. Pat. No. 2,803,517. The only essential steps of the present invention are that the textile materials containing cotton are treated with an emulsion of an aqueous solution of an alkaline compound emulsified in a chlorinated solvent, the emulsion impregnated material steamed, the material then padded with an aqueous solution of a peroxygen compound, and then subjected to the action of steam.

The emulsion used in the process of this invention comprises from about 90 to about 99.9%, and preferably from about 92 to about 98.5%, by weight of a chlorinated hydrocarbon from about 0.1 to about 10%, and preferably from about 1.5 to about 8%, by weight of an aqueous solution of an alkaline compound, and sufficient emulsifier to form a stable emulsion. A particularly preferred emulsion may contain from about 94 to about 97% by weight of chlorinated hydrocarbon and from about 3 to about 6% of an aqueous solution containing from about 10 to about 20% of an alkaline compound and from about 90 to about 80% of water. The particular amount of emulsifier used will depend somewhat on the specific emulsifier or combination thereof selected and the relative amounts of water, alkaline compound and chlorinated hydrocarbon. In general, emulsifier concentrations of about 0.001 to about 5% and preferably from about 0.01 to about 2% by weight have been found to be satisfactory.

The chlorinated solvent employed may be any of those generally known in the art for use in the scouring and bleaching of cotton and is preferably a chlorine derivative of methane or ethane. Chloroform, methylene chloride, perchlorethylene and trichloroethylene are all good solvents for use in the process of this invention. Perchlorethylene is the preferred chlorinated hydrocarbon.

The alkaline compound used to prepare the emulsion may be any alkaline material which will soften the motes contained in the cotton fibers. Strong bases, like the alkali metal hydroxides, are preferred for use in the process of the invention. Illustrative examples of alkaline compounds which may be used to prepare the emulsion include sodium hydroxide, potassium hydroxide, lithium hydroxide, ammonia, and alkali metal alkoxides. The preferred alkaline compound is sodium hydroxide.

The concentration of the alkaline compound used in the aqueous phase of the emulsion is not particularly critical and usually amounts to from about 0.5% to about 60% of the aqueous phase, that is, the aqueous phase of the emulsion comprises about 99.5 to about 40 parts of water and from about 0.5 to about 60 parts of alkaline compound. A particularly preferred emulsion is one where the aqueous phase comprises about 10 to about 20 parts of sodium hydroxide and from about 90 to about 80 parts of water.

The particular emulsifier used to form the stable emulsion used in the process of this invention is not particularly critical and may be any of the well known emulsifiers or emulsifier combinations which are known in the art provided they are capable of producing a stable emulsion of the aqueous solution of the alkaline compound in the chlorinated hydrocarbon solvent. A preferred emulsifier comprises a mixture of one part of sorbitan monooleate and two parts of polyoxyethylene (25) hydrogenated castor oil. Illustrative examples of other emulsifier which may be used include: polyoxyethylene (4) sorbitol hexaoleate, polyoxyethylene (40) sorbital septaoleate, polyoxyethylene (50) sorbital hexaoleate, polyoxyethylene ethers of fatty alcohols such as polyoxyethylene (2) oleyl ether, polyoxyethylene ethers of sorbitan fatty acid esters such as polyoxyethylene (20) sorbitan monooleate and polyoxyethylene (20) sorbitan monopalmitate, sorbitan fatty acid esters such as sorbitan monooleate and sorbitan monolaurate, polyoxyethylene ethers of phenols such as polyoxyethylene (30) nonyl phenol, polyoxyethylene (5) nonyl phenol and polyoxyethylene (11) nonyl phenol, calcium dodecyl benzene sulfonate, polyoxyethylene (40) castor oil, and mixtures thereof.

The emulsion may also contain other additives such as oxidizing agents, chelating agents, surface active agents, scouring auxiliaries, other solvents, and enzymes.

The textile materials containing cotton may be treated with the emulsion by any convenient method known in the art for treating cotton with an organic solvent, for example, by immersion, padding, or spraying. The treatment with the emulsion may be conducted at room temperature or at an elevated temperature. The textile material may be squeezed at intervals during its passage through the emulsion. The emulsion degreases the goods and frees them from any oily matter introduced during processing and any oily matter which may be present in the warp size. The emulsion also conditions the motes so that they are readily softened by the first steaming so that they are readily bleached by the bleaching agent in a subsequent stage.

The period of immersion in the emulsion need only be from a few seconds up to a minute or more in duration. In general times of 5 to 20 seconds are adequate. It will be understood of course that while longer times can be employed there is no advantage to continue the treatment with the emulsion longer than is necessary to contact the goods for sufficient time for the solvent phase of the emulsion to perform its well known function of degreasing the cotton.

After treatment with the emulsion, the goods are subjected to the action of steam to free them of the chlorinated hydrocarbon and to soften the motes contained in the cotton. The period of treatment with steam need only be from a few seconds up to several minutes. Steaming times of 30 seconds to 5 minutes are satisfactory. The use of steam is also particularly advantageous since by its use superior results are obtained during the subsequent bleaching operation, probably owing to the complete and uniform absorbency of the material after the solvent has been removed by the steam.

The textile material after removal of substantially all of the chlorinated hydrocarbon solvent may be impregnated directly with the aqueous solution of a peroxygen compound by any convenient method, for example, by immersion, padding, or spraying. The temperature of the aqueous solution is preferably about or slightly above room temperature since the rate of decomposition of bleaching agents such as hydrogen peroxide rises rapidly as the temperature increases. However, temperatures above room temperature may be used if desired, for example, up to 60° C. It is preferred to insure that steam does not pass into contact with the impregnation bath containing the aqueous solution of bleaching agent. However, it has been found that there is no real advantage in cooling the textile materials, which emerges hot from the solvent removal vessel, prior to application thereto of the aqueous solution of peroxygen compound. Usually, therefore, the impregnation procedure will comprise withdrawing the textile material from the solvent removal vessel, immediately applying thereto the aqueous solution of peroxygen compound at a temperature of about room temperature by padding or immersion, and immediately passing the impregnated textile material into a steam treatment vessel. It is to be understood, however, that the procedure need not be continuous and that the textile material, after solvent removal, may be collected for subsequent impregnation and resteaming which, if desired, may be carried out in a separate apparatus. The full advantage of the present invention, however, is achieved in a continuous process for which the textile material emerges bleached and washed.

The bleaching agent used may be any such agent known for use in bleaching textiles, for example, peroxides, sodium chlorite, sodium hypochlorite and peracetic acid. It is preferred to use hydrogen peroxide. Mixtures of bleaching agents may also be used if desired.

The concentration of bleaching agent in the aqueous solution can be the same as is conventionally used in known aqueous bleaching processes. For example, the concentration of a 35% hydrogen peroxide in the aqueous solution will usually be from 0.5 to 10% by weight of the solution, normally from 1.5 to 6% by weight. The optimum concentration may depend upon the particular textile goods being treated and upon whether the textile goods already contain hydrogen peroxide as a result of a previous treatment. It has been found that for most practical purposes, 35% aqueous hydrogen peroxide in an amount of from 2 to about 5% by weight of the solution is sufficient. By way of example, a suitable concentration for bleaching of 100% cotton fabric or polyester/cotton blend fabrics is about 4% by weight of 35% hydrogen peroxide. If other per-compounds are to be used, an equivalent concentration calculated on the active oxygen present should be used. For any particular fabric, the optimum concentration of bleaching can be determined by simple experiment.

The aqueous solution of bleaching agents may also contain a bleaching adjuvant, for example, a base such a sodium hydroxide. The amount of base preferably is such that the pH of the aqueous solution created on the textile material is greater than 9.0 and preferably is from 10 to about 12.5; for example, 2 to 4% by weight of the solution of 50% sodium hydroxide solution.

In addition to the base, the bleaching solution may also contain one or more stabilizers for the bleaching agent as is conventional in the art and if desired, one or more optical brightening agents. Examples of stabilizing agents which may be used to stabilize hydrogen peroxide are sodium silicate, tetrasodium pyrophosphate and ethylene dinitrilo tetracetic acid.

After the textile material has been treated with an aqueous solution of a bleaching agent, the textile material is steamed in a conventional manner. For example, the textile materials may be passed through the steam treatment continuously or it may be rolled and treated in the form of a roll. The period of steaming will depend upon the temperature employed and on the form, construction and composition of the textile material. Typical steaming periods are about three minutes for continuous open width treatment and up to two hours for batch treatments in which the material is steamed while rolled. Steaming may be carried out under normal pressure conditions in which case steam at about 110° C is employed or it may be carried out above atmospheric pressures in which case steam temperature up to about 130° C may be achieved. In general, the use of superheated steam under pressure reduces the period of steaming, especially when rolls of materials are to be treated.

The process of this invention is primarily of use for the treatment of non-woven cotton, but it may also be satisfactorily used for the treatment of any woven or non-woven materials made from cellulosic fibers or blends of cellulosic fibers and polyester fibers. The textile materials may also be in the form of loose fiber stock, yarn or knit goods.

In a preferred embodiment of the process of the present invention, non-woven cotton goods are passed through one or more enclosed vessels containing an emulsion of an aqueous solution of sodium hydroxide in perchlorethylene maintained at room temperature and then steamed. The goods are then treated with an aqueous solution of hydrogen peroxide and steamed again. The goods are rinsed in water and dried.

The invention is illustrated but in no way limited by the following examples, in which all parts and percentages are by weight unless otherwise stated:

EXAMPLE 1

Seedy, non-woven cotton is immersed in an emulsion containing 96.25% perchlorethylene, 0.50% polyoxyethylene fatty glyceride, 0.25% sorbitan monooleate, and 3% of an aqueous solution of 50 parts water and 50 parts sodium hydroxide to give a 190% wet pickup. The cotton is then suspended in steam at approximately 100° C for 5 minutes. The cotton is then passed from the steamer directly into a solution containing a 2.8% aqueous solution of 50% aqueous hydrogen peroxide at a temperature of 60° C and is immersed therein for 5 to 10 seconds. The cotton is expressed to 100–150% wet pickup and then suspended in steam at approxmately 100° C for 10 minutes. The cotton is then washed in hot water and dried in a hot air oven at approximately 100° C. The dried cotton exhibits susstantially full white shades of high permanency, are highly absorbent, and are substantially free of the natural wax present in cotton.

EXAMPLE 2

Second cut linters are passed through two vessels containing an emulsion of 98.25% perchlorethylene, 0.50% polyoxyethylene fatty glyceride, 0.25% sorbiton monooleate, and 1.00% of a 50% aqueous solution of sodium hydroxide. The temperature of the emulsion is about 25° C, and the total emersion time for the cotton material is about 5 seconds. The cotton is then treated with steam at 100° C for 2 minutes. The cotton is padded in an aqueous solution containing 10 grams per liter sodium peroxide, 5 grams per liter sodium silicate, and 0.5 grams per liter of a wetting and scouring agents consisting of a condensation product of octylated cresol with ethylene oxide. The nip is adjusted so that the cotton is then steamed for one minute and rinsed 4 times in baths containing, respectively, hot water, cold water, very diluted acidic acid, and cold water. The cotton is then dried and found to have a full-white shade of high permanency and to be highly absorbent. The dried cloth is also free of motes and any non-cellulosic impurities which may interfere with the appearance of the cotton after it is dyed or printed.

EXAMPLE 3

Non-woven cotton is immersed in the emulsion used in Example 1 at room temperature and steamed for 50 seconds. The cotton is then immersed in a bleaching bath contaning 6.0% hydrogen peroxide (35% active), 3.0% sodium silicate, 0.5% caustic soda (50% NaOH), 0.05% epsom salt, and 0.2% of a chelating agent. The cotton is then steamed for 13.5 minutes, washed with water, and dried. The dried cotton is absorbent and exhibits full white shades of high permanency.

Although the invention has been described with reference to specific emulsifiers, alkaline compounds, chlorinated hydrocarbons, bleaching agents, and specific cotton goods, it will be apparent that still other different and equivalent materials may be substituted for those specifically described. Moreover, application processes and procedures may be modified or even in some cases eliminated, all within the spirit and scope of this invention.

Having described the invention and what is desired to be secured by Letters Patents is:

1. A multi-stage process for the scouring and bleaching of textile material containing cotton which comprises contacting said textile material with an emulsion comprising (a) from about 0.1 to about 10% by weight of an aqueous solution containing from about 99.5% to about 40 parts of water and from about 0.5 to about 60 parts of an alkaline compound, (b) emulsified in from about 90 to about 99.9% by weight of a chlorinated hydrocarbon, and (c) from about 0.001 to about 5% by weight of an emulsifier; contacting the textile materials with steam to remove the chlorinated hydrocarbon; padding the textile materials in an aqueous solution of a peroxygen compound wherein the temperature of said solution is from about 25° C. to about 60° C.; subjecting the textile materials to the action of steam; and washing the textile materials with water.

2. A process of claim 1 wherein the alkaline compound is an alkali metal hydroxide, the chlorinated hydrocarbon is selected from the group consisting of perchloroethylene, trichloroethane, trichloroethylene, and mixtures thereof.

3. A process of claim 2 wherein the chlorinated hydrocarbon is perchloroethylene.

4. A process of claim 3 wherein the emulsion contains from about 3 to about 6% by weight of an aqueous solution containing from about 10 to about 20 parts of sodium hydroxide and from about 90 to about 80 parts of water.

5. A process of claim 2 wherein the emulsion comprises from 98.5 to 92% of perchloroethylene, from 1.5 to 8% of an aqueous solution of 40 to 90 parts water and 60 to 10 parts sodium hydroxide and from 0.1 to 1.5% of an emulsifier.

6. A process of claim 2 wherein the textile materials are non-woven cotton.

7. A product produced by the process of claim 6.

8. A process of claim 5 wherein the temperature of the emulsion used is from about 25° C. to about 30° C.

9. A process of claim 2 wherein the chlorinated solvent is perchloroethylene and the aqueous solution of peroxygen compound is alkaline.

10. A process of claim 1 wherein the emulsion contains from 98.5 to 92% of perchloroethylene, from 1.5 to 8% of an aqueous solution of from about 40 to 90 parts of water and from about 60 to about 10 parts of sodium hydroxide, and from about 0.1 to 1.5% of an emulsifier, wherein the temperature of the emulsion is from about 25° C. to about 30° C., wherein the aqueous solution of peroxygen compound is about at room temperature, and wherein the textile material treated is non-woven cotton.

* * * * *

UNITED STATES PATENT OFFICE

CERTIFICATE OF CORRECTION

Patent No. 4,076,500 Dated February 28, 1978

Inventor(s) William A. Rearick

It is certified that error appears in the above-identified patent and that said Letters Patent are hereby corrected as shown below:

Column 2, line 56, "the invention" should read --this invention--

Column 3, line 15, "ethylene (4) sorbitol" should read -- ethylene (40) sorbitol --.

Column 3, line 16, "sorbital" in both places should read -- sorbitol --.

Column 5, line 13, "110°C" should read -- 100°C --.

Column 5, line 15, "temperature" should read -- temperatures --.
Column 5, line 51, "approxmately" should read --approximately--.

Column 6, lines 4-5, insert following "The nip is adjusted so that the" the wording -- cotton retains 1 and 1/2 times its weight of liquid. The impregnated --.

Column 6, line 39, "about 99.5% to" should read -- about 99.5 to--

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*